US007176852B2

(12) United States Patent
Tachibana et al.

(10) Patent No.: US 7,176,852 B2
(45) Date of Patent: Feb. 13, 2007

(54) PLASMA DISPLAY PANEL

(75) Inventors: Hiroyuki Tachibana, Osaka (JP); Naoki Kosugi, Kyoto (JP); Toshikazu Wakabayashi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 128 days.

(21) Appl. No.: 10/512,690

(22) PCT Filed: Mar. 23, 2004

(86) PCT No.: PCT/JP2004/003941

§ 371 (c)(1),
(2), (4) Date: Oct. 27, 2004

(87) PCT Pub. No.: WO2004/086444

PCT Pub. Date: Oct. 7, 2004

(65) Prior Publication Data

US 2005/0219160 A1 Oct. 6, 2005

(30) Foreign Application Priority Data

Mar. 24, 2003 (JP) ..... 2003-080304

(51) Int. Cl.
*G09G 3/28* (2006.01)

(52) U.S. Cl. ..... 345/60; 345/67; 315/169.4

(58) Field of Classification Search ..... 345/60, 345/67; 315/169.1, 169.4
See application file for complete search history.

(56) References Cited

U.S. PATENT DOCUMENTS 4,253,044 A * 2/1981 Smith ..... 315/169.4
4,914,352 A * 4/1990 Gay et al. ..... 315/169.4
6,483,491 B1 11/2002 Lee
6,496,167 B2 * 12/2002 Makino ..... 345/60
6,882,328 B2 * 4/2005 Araki ..... 345/60
6,975,285 B2 * 12/2005 Myung ..... 345/60
2004/0095294 A1 * 5/2004 Yamada ..... 345/60

FOREIGN PATENT DOCUMENTS

JP 11-297211 10/1999
JP 2002-169507 6/2002
JP 2002-297091 10/2002

* cited by examiner

*Primary Examiner*—Amr A. Awad
*Assistant Examiner*—Sameer Gokhale
(74) *Attorney, Agent, or Firm*—Wenderoth, Lind & Ponack, L.L.P.

(57) ABSTRACT

A front substrate contains a plurality of scan electrodes and sustain electrodes. Two strips of scan electrodes and two strips of sustain electrodes are alternately disposed on the substrate. In addition, a plurality of auxiliary scan electrodes is disposed on the front substrate so as to be parallel to the scan electrodes. On the back substrate, a plurality of priming electrodes is disposed parallel to the scan electrodes. Each auxiliary scan electrode has electrical connections to the scan electrode that performs scanning earlier than the scan electrode adjacent to each auxiliary scan electrode. With the structure above, a priming discharge occurs between the auxiliary scan electrodes and the priming electrodes.

2 Claims, 7 Drawing Sheets

PLASMA DISPLAY PANEL

TECHNICAL FIELD

The present invention relates to an alternating current (AC) type plasma display panel.

BACKGROUND ART

A plasma display panel (hereinafter referred to as a PDP or simply a panel) is a display device with an excellent visibility, large screen, and low-profile, lightweight body. The difference in discharging divides PDPs into two types of the alternating current (AC) type and the direct current (DC) type. In terms of the structure of electrodes, the PDPs fall into the 3-electrode surface discharge type and the opposing discharge type. In recent years, the dominating PDP is the AC type 3-electrode surface discharge PDP by virtue of its easy fabrication and suitability for high resolution.

Generally, the AC type 3-electrode surface discharge PDP contains a front substrate and a back substrate oppositely disposed with each other, and a plurality of discharge cells therebetween. On a front glass plate of the front substrate, scan electrodes and sustain electrodes as display electrodes are arranged in parallel with each other, and over which, a dielectric layer and a protecting layer are formed to cover the display electrodes. On the other hand, on a back glass plate of the back substrate, data electrodes are disposed in a parallel arrangement, and over which, a dielectric layer is formed to cover the electrodes. On the dielectric layer between the data electrodes, a plurality of barrier ribs is formed in parallel with the rows of the data electrodes. Furthermore, a phosphor layer is formed between the barrier ribs and on the surface of the dielectric layer. The front substrate and the back substrate are sealed with each other so that the display electrodes are orthogonal to the data electrodes in the narrow space, i.e., the discharge space, between the two substrates. The discharge space is filled with a discharge gas. For the full color display, in the panel structured above, gas discharge occurring in each discharge cell generates ultraviolet light, by which phosphors responsible for red (R), green (G), and blue (B) are excited to generate visible light of respective colors.

In the typical panel operation, a TV field is divided into a plurality of sub-fields—known as a sub-field method. According to the sub-field method, gray-scale display on the screen is done by combination of the sub-fields to be lit. Each sub-field has a reset period, an address period, and a sustain period.

In the reset period, a reset discharge occurs in all of the discharge cells. The reset discharge erases the previous log of the wall charges for each discharge cell, and then generates the wall charge required for the following addressing operation. The reset discharge also generates charged particles in the discharge space, that is, causes a priming effect. The charged particles trigger a stable address discharge.

In the address period, a scanning pulse is sequentially applied to the scan electrodes, on the other hand, an address pulse that corresponds to the signal carrying the image to be shown is applied to the data electrodes. The application of each pulse selectively generates address discharge between the scan electrodes and the data electrodes, thereby selectively forming the wall charges.

In the successive sustain period, the required number of sustain pulses is applied between the scan electrodes and the sustain electrodes to turn on the cells of which the wall charges have been formed in the previous address discharge.

As described above, the selective address discharge with a high reliability is indispensable to display an image with high quality on the screen. However, a high voltage cannot be used for the address pulse due to constraints of a circuit structure. Furthermore, the phosphor layer formed on the data electrodes is an obstacle to the smooth discharge. These inconveniences are likely to cause delay in discharge in the address discharge. Therefore, great importance is put on generating the priming particles for a reliable address discharge.

The priming effect brought by the discharge, however, is quickly impaired with the passage of time. In the panel operation described above, inconveniences have occurred in the address discharge. Because the address discharge occurs after a long interval from the reset discharge, the charged particles generated in the reset discharge reduce from the number required for the desired priming, thereby encouraging the delayed discharge. The delay in discharge invites an unstable addressing operation, resulting in a poor quality of image display. As another problem, an extended time for the addressing operation, which was intended to provide the addressing operation with stability, has consumed too much time for the address period.

To tackle the problems above, for example, Japanese Patent Non-Publication No. 2002-297091 suggests a panel and a driving method for the same. According to the suggestion, disposing additional electrodes for performing auxiliary discharge generates priming particles, and by which, the delay in discharge is minimized.

In such structured panel, however, due to a perceptible delay in discharge in the auxiliary discharge itself, the delay in the address discharge cannot be desirably shortened, or the small operation margin of the auxiliary discharge can trigger an improper discharge in some panels.

Furthermore, to achieve higher resolution, increasing the number of the scan electrodes of a panel still having a perceptible delay in the address discharge increases the time spent for the address period, which means the lack of time for the sustain period. As a result, the luminance of the panel lowers. At this time, to improve the luminance, increasing the partial pressure of xenon invites further delay in the address discharge, resulting in an unstable addressing operation.

The present invention deals with the problems above. It is therefore the object of the invention to provide a plasma display panel capable of performing a speedy but stable addressing operation.

DISCLOSURE OF THE INVENTION

According to the plasma display panel of the present invention, auxiliary scan electrodes are disposed parallel with the scan electrodes on the first substrate, and priming electrodes are disposed on the second substrate so as to be parallel with the scan electrodes, so that a discharge is performed between the auxiliary scan electrodes and the priming electrodes.

DETAILED DESCRIPTION OF CARRYING OUT OF THE INVENTION

The plasma display panel of the exemplary embodiments of the present invention is described hereinafter with reference to the accompanying drawings.

First Exemplary Embodiment

Figure 1:
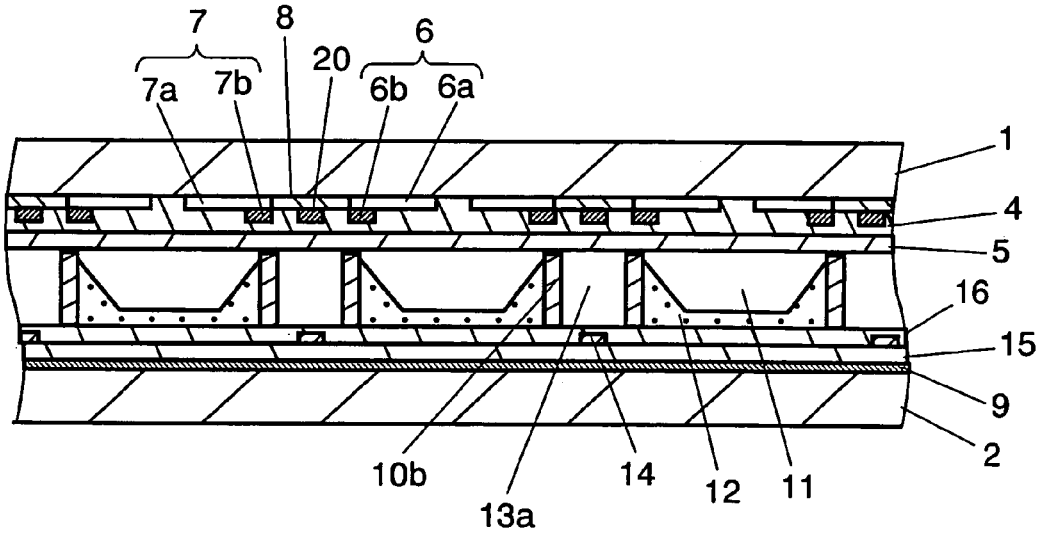
FIG. 1 is a section view illustrating a panel of a first exemplary embodiment of the present invention.
Figure 2:
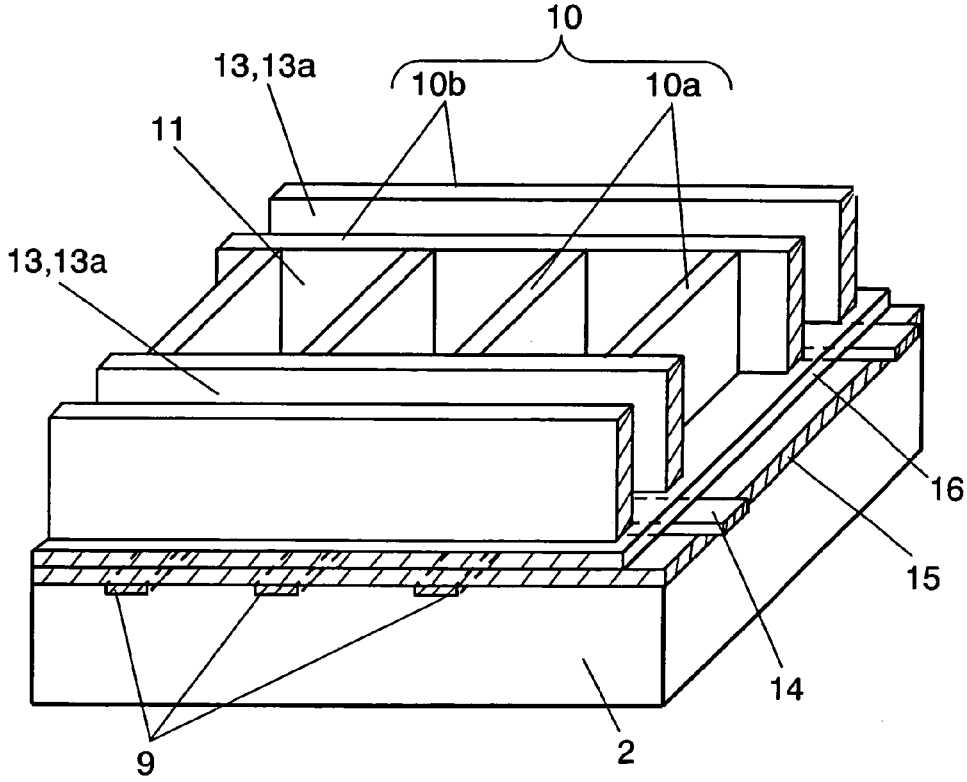
FIG. 2 is a perspective view schematically showing the structure of the back substrate-side of the panel.

FIG. 1 is a section view illustrating a panel of a first exemplary embodiment of the present invention. FIG. 2 is a perspective view schematically showing the structure of the back substrate-side of the panel.

As shown in FIG. 1, front substrate 1 as the first substrate and back substrate 2 as the second substrate, both of which are made of glass, are oppositely disposed via the discharge space. The discharge space is filled with mixed gas of neon and xenon that emits ultraviolet light by the discharge.

On front substrate 1, a plurality of scan electrodes 6, sustain electrodes 7, and auxiliary scan electrodes 20 is formed in parallel arrangement. Scan electrode 6 is formed of transparent electrode 6*a* and metallic bus line 6*b* mounted on electrode 6*a*; similarly, sustain electrode 7 is formed of transparent electrode 7*a* and metallic bus line 7*b* mounted on electrode 7*a*. Between scan electrode 6 and sustain electrode 7 on the side having metallic bus lines 6*b* and 7*b*, light-absorbing layer 8 made of a black-colored material is disposed, and on which, metallic bus line-made auxiliary scan electrode 20 is formed. The array of scan electrodes 6, sustain electrodes 7, and auxiliary scan electrodes 20 is covered with dielectric layer 4 and protecting layer 5.

On back substrate 2, on the other hand, a plurality of data electrodes 9 is formed in parallel, and on which, dielectric layer 15 is disposed so as to cover data electrodes 9. Further, barrier rib 10 is disposed on dielectric layer 15 to divide discharge cells 11. Barrier rib 10 contains, as shown in FIG. 2, vertical walls 10*a* and horizontal walls 10*b*. Vertical walls 10*a* are disposed parallel with data electrodes 9, and horizontal walls 10*b* form discharge cells 11 and gaps 13 between discharge cells 11. In each gap 13, priming electrode 14 is disposed so as to be orthogonal to data electrode 9 to form priming space 13*a* therebetween. Phosphor layer 12 is disposed on a portion of the surface of dielectric layer 15 and on the surface of barrier rib 10 that constitute the sides of each discharge cell 11 divided by barrier rib 10. Gaps 13 have no phosphor layer 12 therein.

Oppositely situated front substrate 1 and back substrate 2 are sealed with each other so that auxiliary scan electrodes 20 disposed on front substrate 1 are parallel with priming electrodes 14 disposed on back substrate 2 via priming spaces 13*a*. That is, in the panel having the structure of FIGS. 1 and 2, priming discharge takes place between auxiliary scan electrodes 20 on front substrate 1 and priming electrodes 14 on back substrate 2.

Although FIGS. 1 and 2 show dielectric layer 16 that covers priming electrodes 14, the structure does not necessarily require dielectric layer 16.

Figure 3:
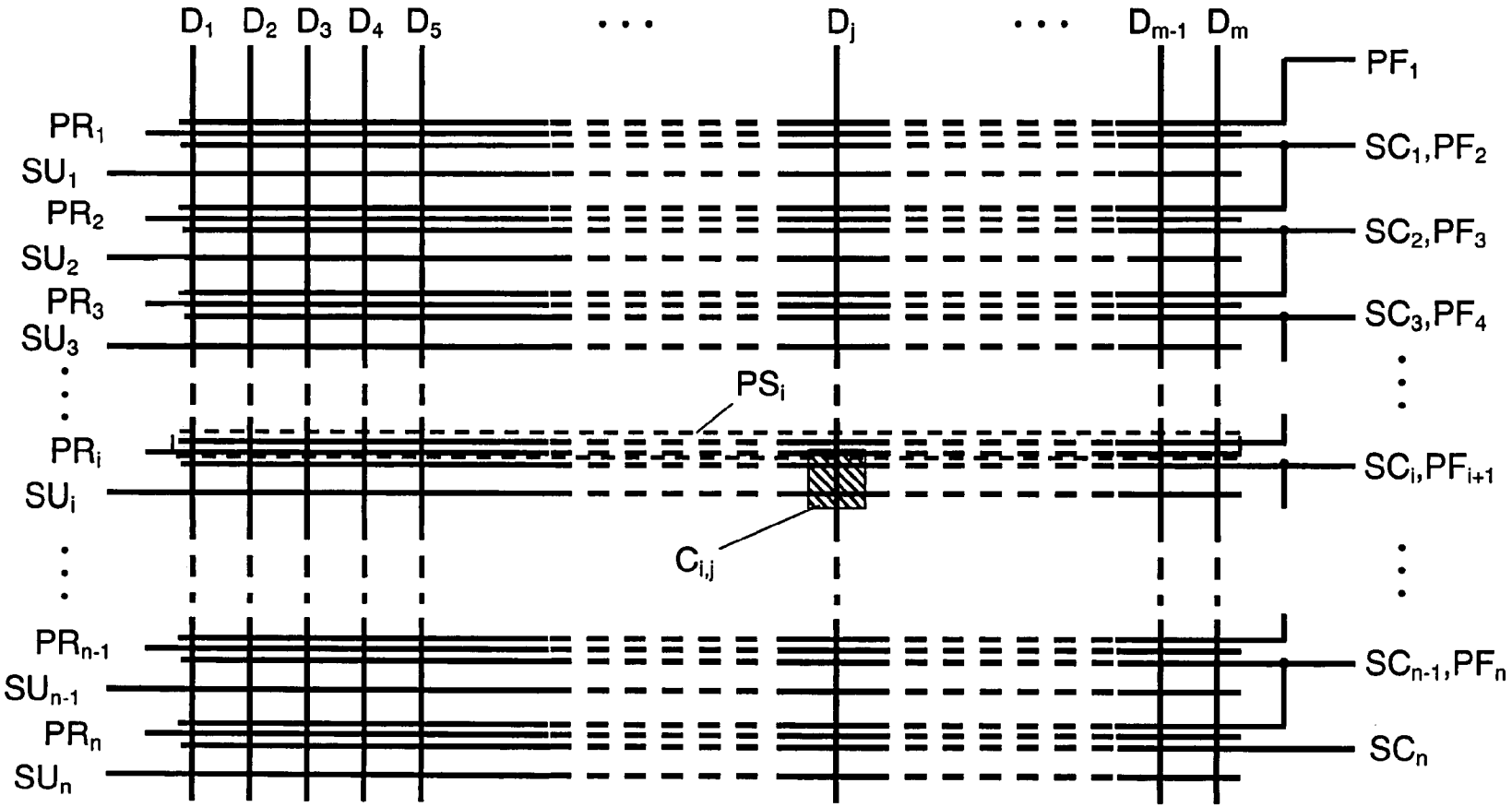
FIG. 3 shows the arrangement of the electrodes of the panel.

FIG. 3 shows the arrangement of the electrodes of the panel of the embodiment. In a direction of rows, m data electrodes $D_1$–$D_m$ (corresponding to data electrodes 9 of FIG. 1) are arranged. On the other hand, in a direction of columns, n auxiliary scan electrodes $PF_1$–$PF_n$ (auxiliary scan electrodes 20 of FIG. 1), n scan electrodes $SC_1$–$SC_n$ (scan electrodes 6 of FIG. 1), and n sustain electrodes $SU_1$–$SU_n$ (sustain electrodes 7 of FIG. 1) are arranged in the order shown in FIG. 3. Auxiliary scan electrode $PF_2$ is connected to scan electrode $SC_1$, auxiliary scan electrode $PF_3$ is connected to scan electrode $SC_2$, . . . , and auxiliary scan electrode $PF_n$ is connected to scan electrode $SC_{n-1}$. Besides, n priming electrodes $PR_1$–$PR_n$ are arranged opposite to auxiliary scan electrodes $PF_1$–$PF_n$. There are m×n discharge cells in the discharge space. Each of the discharge cells, i.e., discharge cell $C_{i,j}$ (corresponding to discharge cell 11 of FIG. 1) has a pair of scan electrode $SC_i$ and sustain electrode $SU_i$ (where, i takes 1 to n), and one data electrode $D_j$ (j takes 1 to m). In gaps 13, n priming space $PS_i$ (corresponding to priming space 13*a* of FIG. 1) having auxiliary scan electrode $PF_i$ and priming electrode $PR_i$ are formed.

Figure 4:
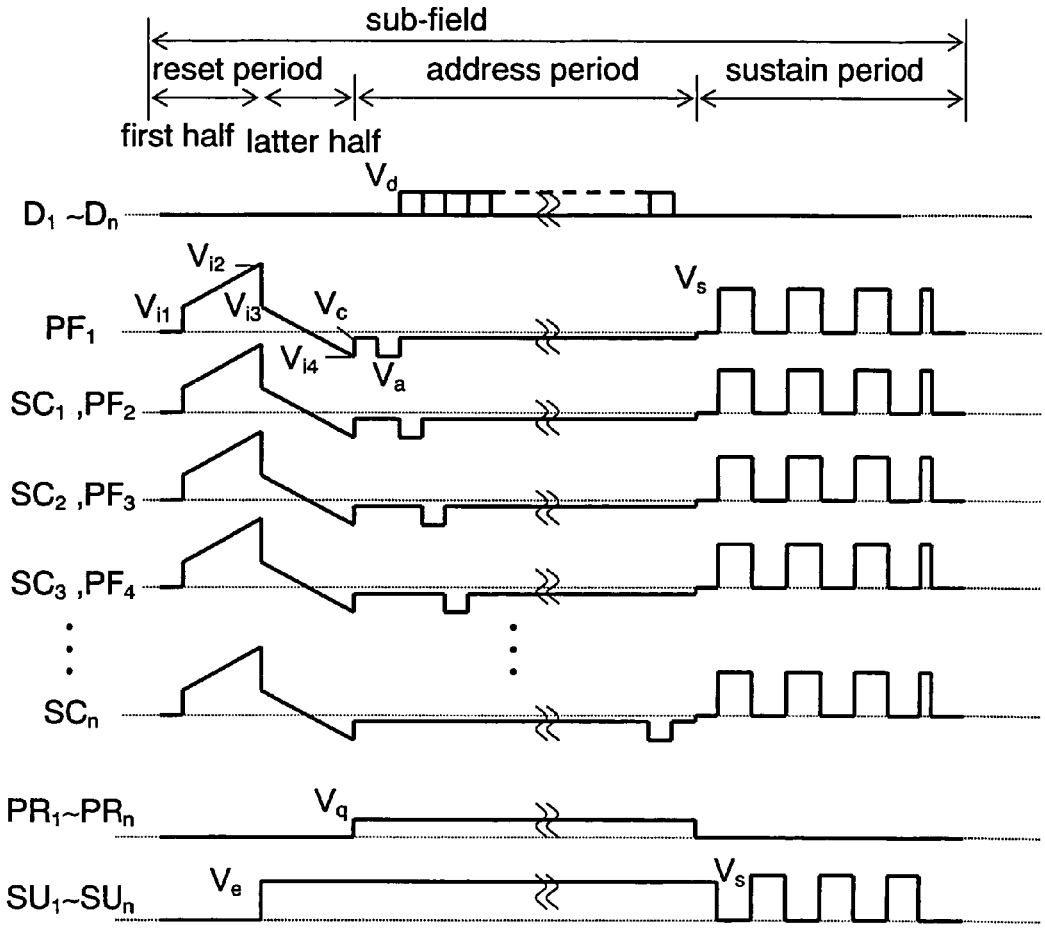
FIG. 4 shows voltage waveforms for driving the panel.

Here will be described voltage waveforms and application timing of voltage for driving a panel. FIG. 4 shows the waveforms for driving the panel of the first exemplary embodiment. A TV field is formed of a plurality of sub-fields each of which has a reset, address, and sustain period. The sub-fields similarly work although each has the different number of sustain pulses in the sustain period. The description below will be given on the operations of an arbitrary sub-field.

In the first half of the reset period, data electrodes $D_1$–$D_m$, sustain electrodes $SU_1$–$SU_n$, and priming electrodes $PR_1$–$PR_n$ are kept at 0V; meanwhile, a voltage having an inclined waveform is applied to scan electrodes $SC_1$–$SC_n$ and auxiliary scan electrodes $PF_1$–$PF_n$. The inclined waveform voltage has a mild increase from voltage $Vi_1$, which is smaller than the discharge starting voltage for sustain electrodes $SU_1$–$SU_n$, to voltage $Vi_2$ greater than the discharge starting voltage. In the period of increasing incline of the waveform, a minor first-time reset discharge occurs between scan electrodes $SC_1$–$SC_n$ and sustain electrodes $SU_1$–$SU_n$, data electrodes $D_1$–$D_m$, priming electrodes $PR_1$–$PR_n$. As a result, negative wall voltage builds up on scan electrodes $SC_1$–$SC_n$, while positive wall voltage builds up on data electrodes $D_1$–$D_m$, sustain electrodes $SU_1$–$SU_n$, and priming electrodes $PR_1$–$PR_n$. The wall voltage on electrodes represents a voltage generated by the wall charges accumulated on the dielectric layer disposed over the electrodes.

In the latter half of the reset period, sustain electrodes $SU_1$–$SU_n$ are maintained at positive voltage Ve; meanwhile, a voltage having a negatively inclined waveform is applied to scan electrodes $SC_1$–$SC_n$ and auxiliary scan electrode $PF_2$. The inclined waveform voltage has a mild decrease from voltage $Vi_3$, which is smaller than the discharge starting voltage for sustain electrodes $SU_1$–$SU_n$, down to voltage $Vi_4$ that exceeds the level of the discharge starting voltage. In the period of decreasing slope of the waveform, a minor second-time reset discharge occurs between scan electrodes $SC_1$–$SC_n$ and sustain electrodes $SU_1$–$SU_n$, data electrodes $D_1$–$D_m$, priming electrodes $PR_1$–$PR_n$. Consequently, the negative wall voltage on scan electrodes $SC_1$–$SC_n$ and the positive wall voltage on sustain electrodes $SU_1$–$SU_n$ are lessened, the positive wall voltage is properly controlled for the addressing, and also the positive wall voltage is properly controlled for the priming. The operations in the reset period thus completes.

In the address period, firstly, scan electrodes $SC_1$–$SC_n$ and auxiliary scan electrodes $PF_1$–$PF_n$ are maintained at voltage Vc, and priming electrodes $PR_1$–$PR_n$ are maintained at voltage Vq, and then scan pulse voltage Va is applied to auxiliary scan electrode $PF_1$ located at the first row. The application of the voltage causes a priming discharge between priming electrode $PR_1$ and auxiliary scan electrode $PF_1$, so that the charged particles are spread around within discharge cell $C_{1,1}$–$C_{1,m}$ corresponding to first-row scan electrode $SC_1$.

Next, scan pulse voltage Va is applied to first-row scan electrode $SC_1$, and positive address pulse voltage Vd is applied to data electrode $D_k$ (where, k takes an integer from 1 to m) corresponding to the image signal to be shown on the first row. The application of voltage causes a discharge at the intersection of data electrode $D_k$ and scan electrode $SC_1$, and the discharge triggers another discharge between sustain electrode $SU_1$ and scan electrode $SC_1$ corresponding to discharge cell $C_{1,k}$. Through the discharge, the positive wall voltage builds up on scan electrode $SC_1$ of discharge cell $C_{1,k}$, on the other hand, the negative wall voltage builds up on sustain electrode $SU_1$ of discharge cell $C_{1,k}$. The addressing operations thus complete.

In the addressing, the discharge at first-row discharge cell $C_{1,k}$ having first-row scan electrode $SC_1$ is performed under the condition with a sufficient amount of charged particles fed by the priming discharge, which was previously occurred between auxiliary scan electrode $PF_1$ and priming electrode $PR_1$. The proper priming provides the discharge of discharge cell $C_{1,k}$ with minimized delay in discharge. Thereby, a speedy but stable discharge can be obtained.

At this time, scan pulse voltage Va is also applied to second-row auxiliary scan electrode $PF_2$ connected to first-row scan electrode $SC_1$, whereby a priming discharge is caused between auxiliary scan electrode $PF_2$ and second-row priming electrode $PR_2$. In this way, the charged particles are spread around within discharge cell $C_{2,1}$–$C_{2,m}$ corresponding to second-row scan electrode $SC_2$.

In the same manner, scan pulse voltage Va is applied to second-row scan electrode $SC_2$ to perform the discharge in the second row, and at the same time, a priming discharge is performed between third-row auxiliary scan electrode $PF_3$ and third-row priming electrode $PR_3$. The successively occurred address discharges are performed under the condition with a sufficient amount of charged particles fed by the previously occurred priming discharge. Thereby, a speedy but stable discharge can be obtained. In this way, the row-by-row addressing operation is performed, and when discharge cell $C_{n,k}$ on the last row is addressed, the address operation completes.

In the sustain period, the voltage to be applied to scan electrodes $SC_1$–$SC_n$ and sustain electrodes $SU_1$–$SU_n$ is reset to 0V, and then positive sustain pulse Vs is applied to scan electrodes $SC_1$–$SC_n$. In the application of voltage, sustain pulse voltage Vs is added to each wall voltage on scan electrode $SC_i$ and sustain electrode $SU_i$, and the voltage between scan electrode $SC_i$ and sustain electrode $SU_i$ of discharge cell $C_{i,j}$ exceeds the discharge starting voltage, so that the sustain discharge occurs. In the same manner, discharge cell $C_{i,j}$ has a series of the sustain discharges corresponding to the number of the sustain pulses alternately applied to scan electrodes $SC_1$–$SC_n$ and sustain electrodes $SU_1$–$SU_n$.

In the conventional panel operation, the address discharge has been highly dependent on the priming particles fed by the reset discharge. In contrast, the address discharge of the present invention, as described above, is performed under the condition with a sufficient amount of charged particles fed by the priming discharge, which occurred just before addressing operations for each discharge cell. The priming discharge realizes a speedy but stable address discharge with minimized delay in discharge, thereby providing images with high quality.

Second Exemplary Embodiment

Figure 5:
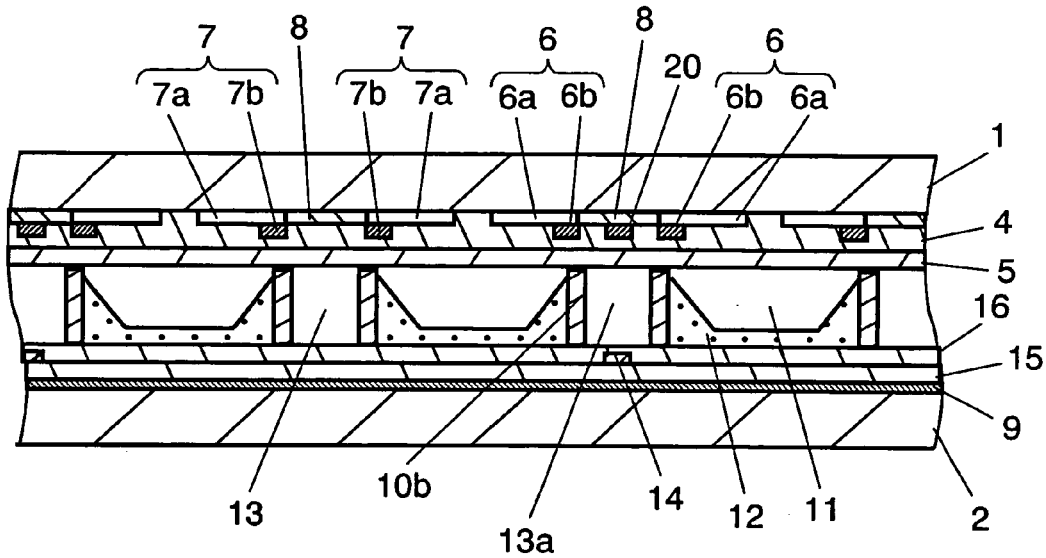
FIG. 5 is a section view illustrating a panel of a second exemplary embodiment of the present invention.
Figure 6:
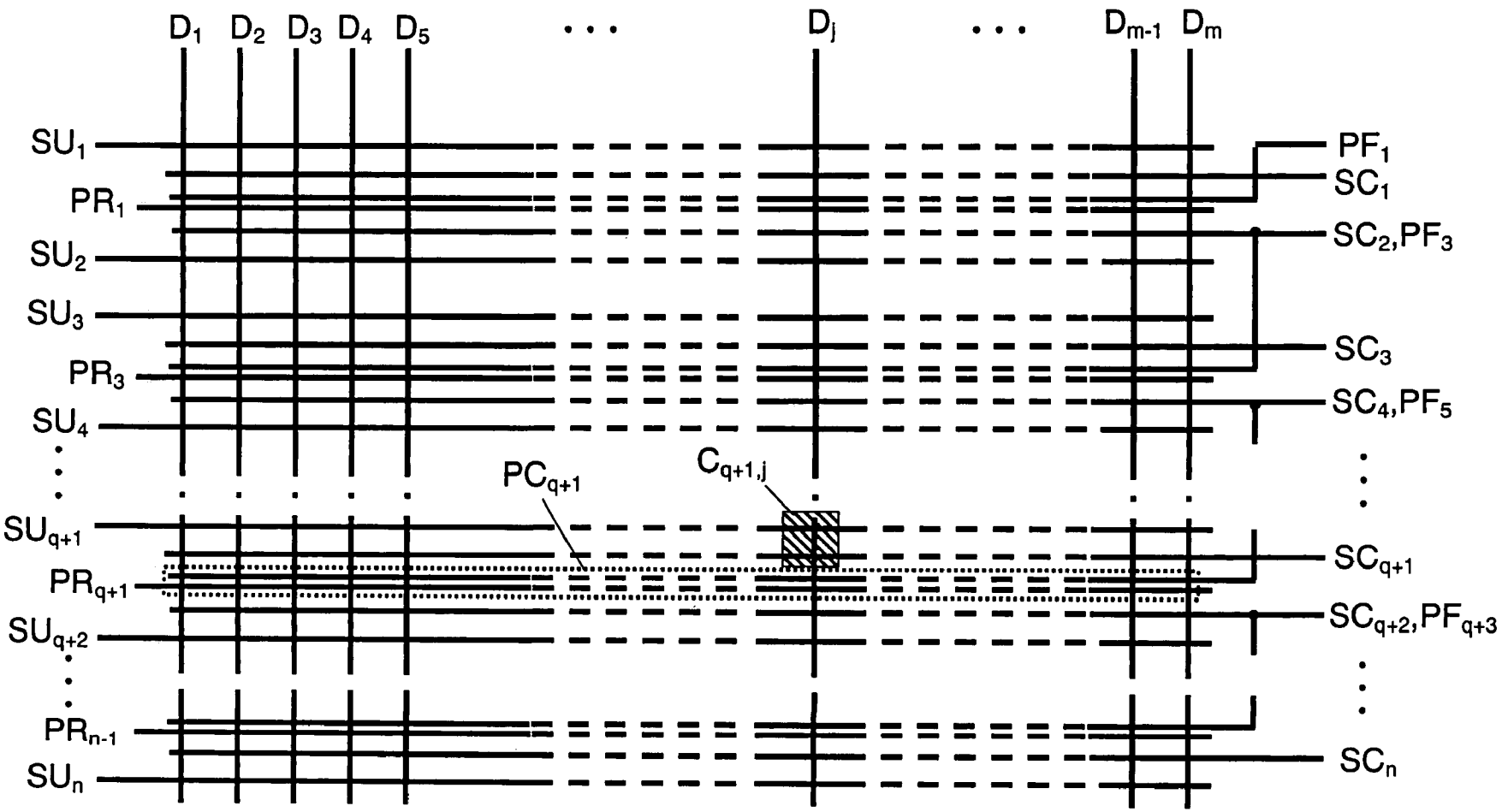
FIG. 6 shows the arrangement of the electrodes of the panel.

FIG. 5 is a section view illustrating a panel of a second exemplary embodiment of the present invention. FIG. 6 shows the arrangement of the electrodes of the panel. Elements similar to those in the first embodiment have the same reference marks, and the descriptions of those elements are omitted. The structure of the embodiment differs from that of the first embodiment in that two strips of scan electrodes 6 and two strips of two sustain electrodes 7 are alternately disposed on the panel. Accordingly, priming electrode 14 and auxiliary scan electrode 20 are disposed only in gap 13 that corresponds to the area between scan electrodes 6 to form priming space 13*a*.

In the panel of the first embodiment, n auxiliary scan electrodes 20 and n priming electrodes 14 are disposed in each gap 13, whereas in the panel of the second embodiment, half the n rows of auxiliary scan electrodes 20 and half the n rows of priming electrodes 14 are formed in every other gap 13. With the structure above, a priming discharge occurs between auxiliary scan electrode 20 disposed on front substrate 1 and priming electrode 14 disposed on back substrate 2. That is, in the panel of the second embodiment, one-row priming space 13*a* is responsible for supplying priming particles to the discharge cell over two rows.

Here will be described the voltage waveforms and the application timing of the voltage for driving a panel.

Figure 7:
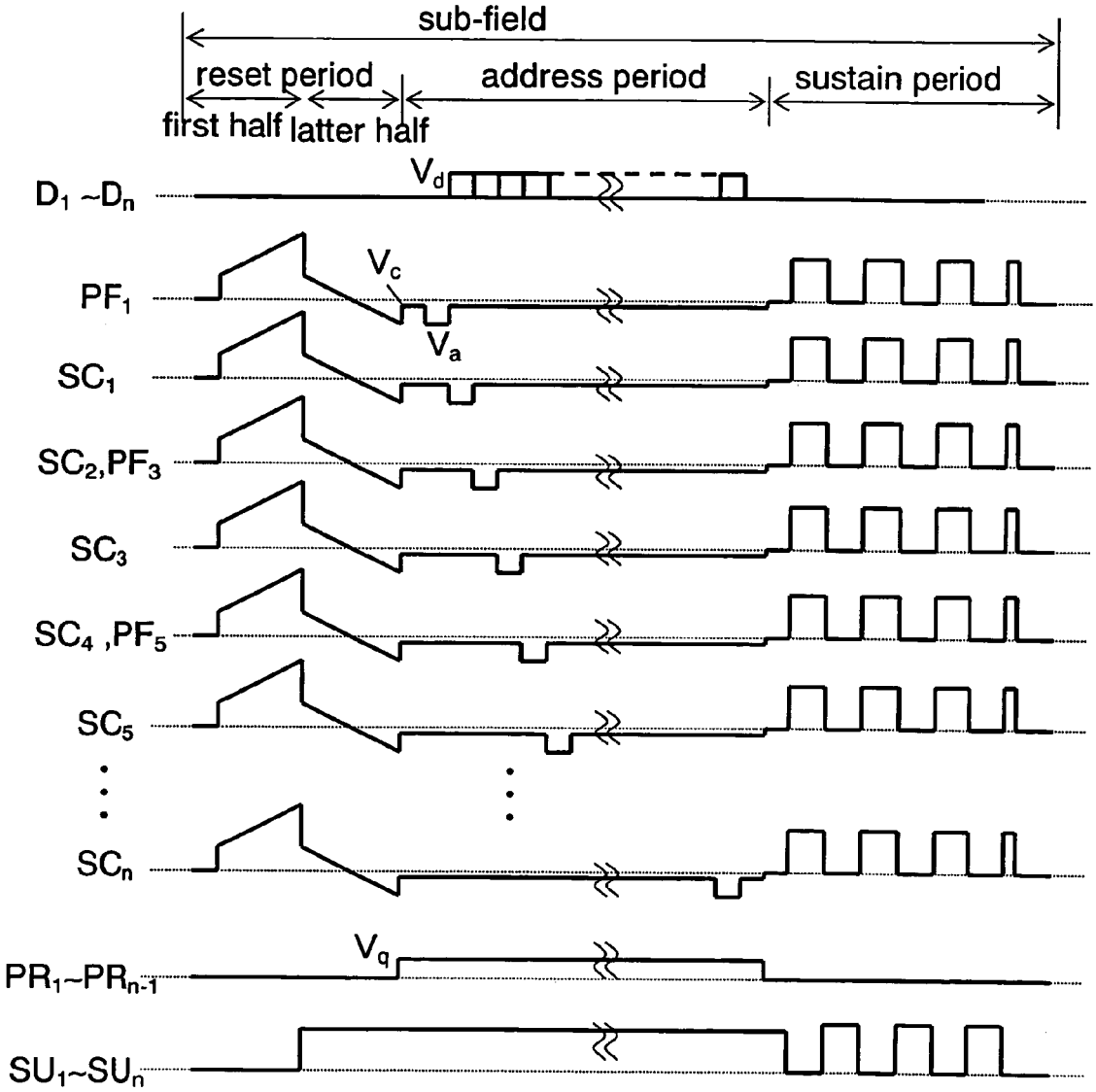
FIG. 7 shows voltage waveforms for driving the panel.

FIG. 7 shows the waveforms for driving the panel of the second embodiment. The descriptions of the second embodiment, like in the first embodiment, will be focused on the operations in any given sub-field. The operation in the reset period is similar to that of the first embodiment, and the explanation will be omitted.

In the address period, firstly, voltage Vc is applied to scan electrodes $SC_1$–$SC_n$ and auxiliary scan electrodes $PF_1$–$PF_n$. On the other hand, voltage Vq is applied to priming electrodes $PR_i$–$PR_n$. Next, scan pulse voltage Va is applied to first-row auxiliary scan electrode $PF_1$. The application of voltage causes a priming discharge between auxiliary scan electrode $PF_1$ and priming electrode $PR_1$. The discharge generates priming particles not only in first-row discharge cells $C_{1,1}$–$C_{1,m}$, which correspond to scan electrode $SC_1$, but also in second-row discharge cells $C_{2,1}$–$C_{2,m}$ corresponding to scan electrode $SC_2$.

After that, scan pulse voltage Va is applied to first-row scan electrode $SC_1$, and address pulse voltage Vd corresponding to an image signal is applied to data electrode $D_k$, whereby first-row discharge cell $C_{1,k}$ is addressed.

Similarly, scan pulse voltage Va is applied to second-row scan electrode $SC_2$, and address pulse voltage Vd corresponding to an image signal is applied to data electrode $D_k$, whereby second-row discharge cell $C_{2,k}$ is addressed. At this time, scan pulse voltage Va is also applied to third-row auxiliary scan electrode $PF_3$ connected to second-row scan electrode $SC_2$. The application of voltage causes a priming discharge between third-row auxiliary scan electrode $PF_3$ and third-row priming electrode $PF_3$. The priming discharge generates priming particles not only in third-row discharge cells $C_{3,1}$–$C_{3,m}$, which correspond to scan electrode $SC_3$, but also in fourth-row discharge cells $C_{4,1}$–$C_{4,m}$ corresponding to scan electrode $SC_4$.

In the addressing, when discharge cells $C_{p,1}$–$C_{p,m}$ (p takes an odd number, i.e., 1, 3, 5, . . . ) are addressed, no priming discharge occurs. On the other hand, in the addressing of discharge cells $C_{q,1}$–$C_{q,m}$ (q takes an even number, i.e., 2, 4, 6, . . . ), scan pulse voltage Va is also applied to $(q+1)^{th}$-row auxiliary scan electrode $PF_{q+1}$ connected to $q^{th}$-row scan electrode $SC_q$. The application of voltage causes a priming discharge between $(q+1)^{th}$-row auxiliary scan electrode $PF_{q+1}$ and $(q+1)^{th}$-row priming electrode $PR_{q+1}$. The priming discharge generates priming particles not only in $(q+1)^{th}$-row discharge cells $C_{q+1,1}$–$C_{q+1,m}$, but also in $(q+2)^{th}$-row discharge cells $C_{q+2,1}$–$C_{q+2,m}$.

The addressing is thus performed row by row and, when $n^{th}$-row discharged cells have been addressed, the address period completes.

The operation in the sustain period is similar to that of the first embodiment, and the explanation will be omitted.

As described above, the address discharge in the panel of the invention takes place under the condition that the priming discharge caused just before the addressing operations on the discharge cells supplies sufficient priming particles. The desired priming contributes to a speedy but stable address discharge with minimized delay in discharge.

Besides, in the structure of the second embodiment, the electrodes adjacent to priming space 13*a* are priming electrode 14 and scan electrode 6 only. Such a structure provides the priming discharge with stability without causing an undesired discharge with sustain electrode 7.

In an AC-PDP, the dielectric layer covers the electrodes to isolate them from the discharge space. Therefore, a direct current component has no contribution to the discharge itself. It will be understood that a waveform in which a direct current component is added to the driving waveform described in the first and second embodiments can provide the same effect.

Although auxiliary scan electrode $PF_1$ corresponding to first-row discharge cells $C_{1,1}$–$C_{1,m}$ is disposed on the panel of the first and second embodiments, the panel does not necessarily require auxiliary scan electrode $PF_1$. Because that the address operations on first-row discharge cells $C_{1,1}$–$C_{1,m}$ can be performed with the help of the priming particles generated in the reset period.

Figure 8:
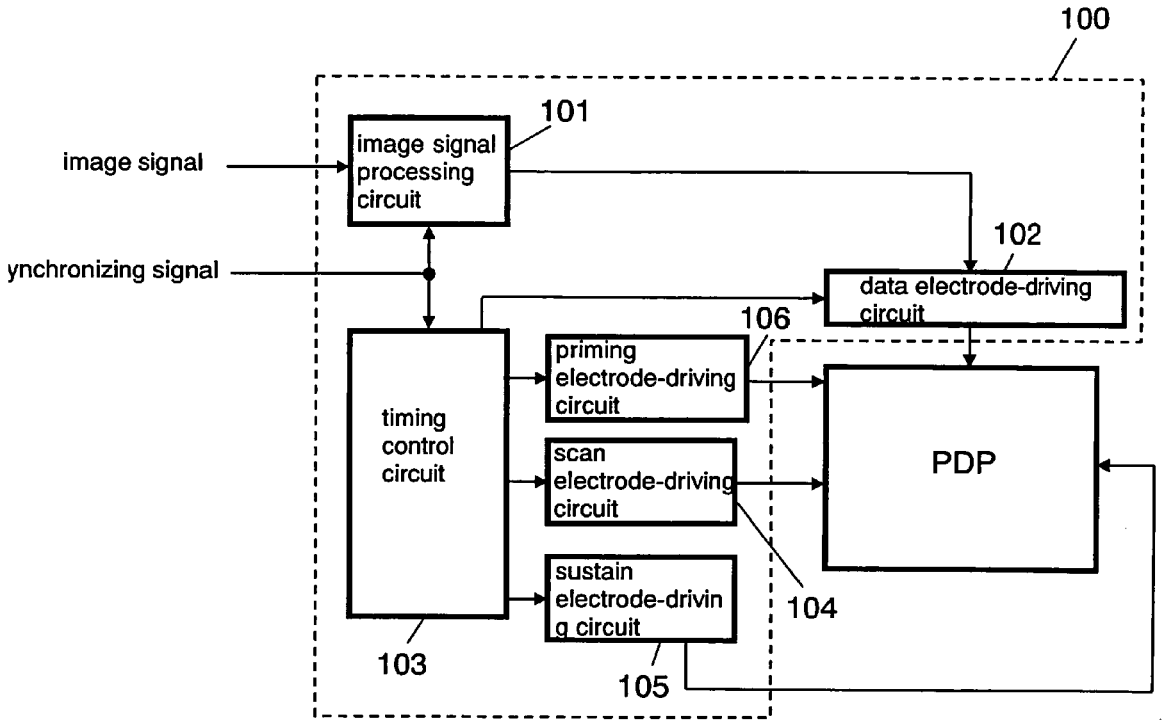
FIG. 8 is a circuit block diagram of the driving device of the panels of the first and the second embodiments.

FIG. 8 is a circuit block diagram of the driving device of the panels of the first and the second embodiments. Driving device 100 of the embodiments of the present invention contains image signal processing circuit 101, data electrode driving circuit 102, timing control circuit 103, scan electrode driving circuit 104, sustain electrode driving circuit 105, and priming electrode driving circuit 106. Image signal processing circuit 101 sends a sub-field control signal according to an image signal and a synchronizing signal. The sub-field control signal determines a sub-field to be turned ON or OFF. The synchronizing signal is also fed into timing control circuit 103. According to the synchronizing signal, timing control circuit 103 sends a timing control signal to data electrode driving circuit 102, scan electrode driving circuit 104, sustain electrode driving circuit 105, and priming electrode driving circuit 106.

According to the sub-field control signal and the timing control signal, data electrode driving circuit 102 generates a driving waveform to be applied to data electrodes 9 (corresponding to data electrodes $D_1$–$D_m$ in FIG. 3). Scan electrode driving circuit 104 generates, according to the timing signal, a driving waveform to be applied to scan electrodes 6 (scan electrodes $SC_1$–$SC_n$ of FIG. 3) and auxiliary scan electrodes 20 (auxiliary scan electrodes $PF_1$–$PF_{n-1}$ of FIG. 3); sustain electrode driving circuit 105 generates, according to the timing signal, a driving waveform to be applied to sustain electrodes 7 (sustain electrodes $SU_1$–$SU_n$ of FIG. 3); and priming electrode driving circuit 106 generates, according to the timing signal, a driving waveform to be applied to priming electrodes 14 (corresponding to priming electrodes $PR_i$–$PR_{n-1}$ of FIG. 3). Power supply circuit (not shown) feeds electric power to data electrode-driving circuit 102, scan electrode-driving circuit 104, sustain electrode-driving circuit 105, and priming electrode-driving circuit 106.

The aforementioned circuit block constitutes the driving device employing the PDP of the present invention.

The PDP of the present invention thus provides speedy but stable address operations.

INDUSTRIAL APPLICABILITY

The plasma display panel of the present invention, in which the address operations can be performed at high-speed with stability, is effectively used for a plasma display device.

The invention claimed is:

1. A plasma display panel comprising:

a first substrate and a second substrate facing each other via a discharge space;

a plurality of scan electrodes, a plurality of sustain electrodes, and a plurality of auxiliary scan electrodes disposed on the first substrate, said scan, sustain, and auxiliary electrodes being parallel to each other and being arranged in a repeating sequence of sustain electrode, sustain electrode, scan electrode, auxiliary scan electrode, and scan electrode;

a dielectric layer covering at least the scan electrodes and sustain electrodes;

a plurality of data electrodes disposed on the second substrate so as to be orthogonal to the scan electrodes; and a plurality of priming electrodes disposed on the second substrate so as to be parallel to the scan electrodes and to cause a discharge between the priming electrodes and the auxiliary scan electrodes.

2. The plasma display panel according to claim 1, wherein each auxiliary scan electrode is electrically connected to a scan electrode that performs scanning earlier than a scan electrode adjacent to the auxiliary scan electrode.

* * * * *